US006041682A

United States Patent [19]

Jensen et al.

[11] Patent Number: 6,041,682

[45] Date of Patent: Mar. 28, 2000

[54] KNIFE FIXTURE WITH BROKEN BLADE DETECTOR

[75] Inventors: Richard B. Jensen, Caldwell, Id.; Patrick J. Linder, Hermiston, Oreg.

[73] Assignee: J.R. Simplot Company, Boise, Id.

[21] Appl. No.: 09/275,593

[22] Filed: Mar. 24, 1999

Related U.S. Application Data

[62] Division of application No. 08/838,826, Apr. 10, 1997, Pat. No. 5,904,083.

[51] Int. Cl.[7] ..... B26D 5/00

[52] U.S. Cl. ..... 83/13; 83/62; 83/62.1; 83/522.12; 83/932

[58] Field of Search ..... 83/62, 62.1, 932, 83/522.27, 522.12, 9, 13; 451/8; 408/6, 16

[56] References Cited

U.S. PATENT DOCUMENTS

| | | | |
|---|---|---|---|
| Re. 32,822 | 1/1989 | Hodges et al. | 83/858 |
| 1,447,421 | 12/1923 | Brooks . | |
| 2,337,629 | 12/1943 | Shortell . | |
| 2,539,796 | 1/1951 | Shortell . | |
| 3,109,468 | 11/1963 | Lamb et al. . | |
| 3,463,211 | 8/1969 | Holz . | |
| 3,747,142 | 7/1973 | Arbogast et al. | 83/62 |
| 3,750,338 | 8/1973 | Stolzer . | |
| 4,082,024 | 4/1978 | Hodges et al. | 83/858 |
| 4,142,405 | 3/1979 | Stevens . | |
| 4,372,184 | 2/1983 | Fisher et al. | 83/98 |
| 4,383,449 | 5/1983 | Mickowski . | |
| 4,664,571 | 5/1987 | Takada et al. | 83/62.1 |
| 4,719,802 | 1/1988 | Adini . | |
| 4,766,793 | 8/1988 | Fischer et al. | 83/698 |
| 4,771,665 | 9/1988 | Van Doorn et al. | 83/62.1 |
| 4,922,762 | 5/1990 | Loring . | |
| 5,009,141 | 4/1991 | Julian et al. | 83/932 |
| 5,031,360 | 7/1991 | Farnworth et al. | 83/62.1 |
| 5,058,478 | 10/1991 | Mendenhall | 83/857 |
| 5,095,794 | 3/1992 | Mendenhall | 83/858 |
| 5,125,308 | 6/1992 | Mendenhall | 83/932 |
| 5,343,623 | 9/1994 | Cole et al. | 30/304 |
| 5,383,444 | 1/1995 | Kimura | 451/8 |
| 5,421,226 | 6/1995 | Mendenhall | 83/932 |
| 5,584,216 | 12/1996 | Sinjen | 83/62.1 |
| 5,904,083 | 5/1999 | Jensen et al. | 83/62 |

FOREIGN PATENT DOCUMENTS

| | | | |
|---|---|---|---|
| 619552 | 5/1961 | Canada | 83/62 |

OTHER PUBLICATIONS

Model VSC Strip Cutter—Machine description, p. 76.

Velocicut Cutting Head—Model VSC with Velocicut Head, p. 77.

*Primary Examiner*—M. Rachuba

*Attorney, Agent, or Firm*—Kelly Bauersfeld Lowry & Kelley, LLP

[57] ABSTRACT

An improved knife fixture is provided of the type having a plurality of knife blades for cutting food products, such as cutting potatoes into elongated French fry strips, wherein the knife fixture includes a detector system and method for promptly indicating breakage of a knife blade. The knife fixture generally comprises a fixture frame adapted to support the plurality of knife blades under tension during normal cutting operation, in accordance with the knife fixture disclosed in U.S. Pat. No. 5,343,623. The detector system and method comprises, in one preferred form, mounting the knife blades for passage of an electrical current and monitoring the current level for abrupt changes indicative of a broken blade. In another preferred form, a strain gauge is provided on the fixture frame to measure the tension force applied to the knife blades, and to permit monitoring of abrupt changes in tension indicative of a broken blade.

17 Claims, 5 Drawing Sheets

KNIFE FIXTURE WITH BROKEN BLADE DETECTOR

This is a division of U.S. Ser. No. 08/838,826, filed Apr. 10, 1997, now U.S. Pat. No. 5,904,083.

BACKGROUND OF THE INVENTION

This invention relates generally to knife fixtures and related knife blades for use in cutting food products, particularly such as cutting potatoes into elongated French fry strips and the like. More specifically, this invention relates to an improved knife fixture of the type including a plurality or grid of knife blades for cutting food products, wherein the knife fixture includes means for monitoring the knife blades to provide a prompt indication of a broken blade.

Knife fixtures for use in cutting food products into elongated strips are well known in the art, particularly in the potato industry for cutting potatoes into French fries. In one common form, such knife fixtures include a plurality or grid of knife blades mounted along a tubular pathway through which potatoes are propelled in rapid succession one at a time by a water flow stream or the like for passage into cutting engagement with the knife blades. The potatoes are propelled with a sufficient force to drive the potatoes through the knife fixture, whereby the each potato is cut into a plurality of elongated strips. In one fixture configuration, relatively sturdy knife blades are assembled in a complex tree-like arrangement defining a grid of cutting edges which intersect at right angles for cutting each potato into strips. See, for example, U.S. Pat. Nos. 3,109,468 and Re. 32,822. In another and considerably simplified form, a pair of knife fixtures are provided, each including a plurality of relatively lightweight knife blades arranged with cutting edges in parallel relation; the pair of knife fixtures are installed in close series succession along the passage, with the sets of blades of the two fixtures oriented generally perpendicular to each other for cutting each potato into strips. See, for example, U.S. Pat. No. 5,343,623. The latter knife fixture construction beneficially provides a simplified and economical blade shape which can be supported under tension to provide improved food product cutting without requiring a highly sharpened cutting edge.

Knife fixtures of the general type described above are widely used in the potato processing and other foods processing industries, for cutting large quantities of food products in a relatively short period of time. However, the knife blades are susceptible to breakage or damage to the cutting edges, especially in the event that a foreign object such as a rock is propelled along the production passage into contact with the knife blades. Alternately, a foreign object such as a rock can become lodged or stuck in the production passage at the knife fixture. The occasional presence of a rock or the like in the production passage is difficult to prevent in the potato processing industry wherein potatoes are processed at a high production rate and many rocks visually appear similar to a small potato.

When one of these problems occurs, subsequent potatoes may fail to pass through the knife fixture resulting in substantially immediate obstruction of the production passage. In the past, the production passage typically encounters substantial plugging before the existence of the broken blade can be identified and the production line shut down for remedial action. Significant time has been required to unplug the production passage, in addition to repairing the knife fixture, before normal production can be resumed. Alternatively, in the event that the broken blade does not result in obstruction of the production passage, the knife fixture will typically produce poorly cut or improperly cut products of marginal or unacceptable cut quality. A significant quantity of unacceptable product can be produced in a short period of time, unless the product cut quality is regularly and closely monitored for prompt identification of a broken knife fixture blade.

The present invention relates to a modified knife fixture having a plurality of knife blades for cutting food products such as potatoes into strips, wherein the knife fixture includes a detector system and method for substantially immediately identifying a broken knife blade so that the production line can be halted substantially immediately without significant obstruction, and without significant production of unacceptable products, thereby permitting rapid replacement or repair of the knife fixture and a corresponding rapid resumption of normal operation.

SUMMARY OF THE INVENTION

In accordance with the invention, an improved knife fixture is provided for cutting food products such as potatoes and the like into elongated strips. The knife fixture includes a plurality of knife blades supported on a fixture frame adapted for mounting along a production passage through which the food products are propelled one at a time in rapid succession. A broken blade detector system and related method are provided for monitoring the knife blades, and for substantially immediately indicating the occurrence of a broken blade. The detector system can be coupled with an appropriate production line controller to promptly interrupt the supply of the food products along the production passage, upon detection of a broken blade.

In a preferred form of the invention, the knife fixture is constructed generally according to the knife fixture disclosed and described in U.S. Pat. No. 5,343,623, which is incorporated by reference herein. In such knife fixture, the plurality of knife blades are supported on a fixture frame in generally parallel relation. The knife fixture comprises a base member having one end of the knife blades connected thereto, and a tension bar having the opposite end of the knife blades connected thereto. The tension bar is movably adjusted relative to the base member to apply a selected tension force to the knife blades. In accordance with the invention, the base member and the tension bar include alternately positioned conductive and insulating spacers to arrange the knife blades in electrical series relation. An electrical current is passed through the knife blades and the current level is monitored during normal cutting operation. When the current abruptly falls, a broken blade is indicated. Alternately, the knife blades may be electrically coupled in parallel relation and abrupt changes in current level monitored to indicate blade breakage.

In another preferred form of the invention, the knife blades are mounted under tension between the base frame and the tension bar of the fixture frame, as described above. At least one strain gauge is provided on the fixture frame to measure and monitor the tension force applied to the knife blades. A broken blade will be indicated by an abrupt change in the monitored tension force.

Detection of a broken blade can be automatically inputted to the production line controller, to result in activating an alarm and/or substantially immediate production line shutdown pending remedial action. Such remedial action may include removal and repair of the broken blade, or alternately include removal of the entire knife fixture and immediate replacement with another fixture while the broken blade is repaired. In this regard, a plurality of knife fixtures can be mounted on a rotatable index wheel adapted for rotational movement to advance the knife fixtures one at a time into an operational position along the production passage. When a broken blade is detected, the index wheel can be rotated by the controller to move the fixture with the broken blade out of the production passage, and to move a replacement fixture into the production passage for resumed production.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
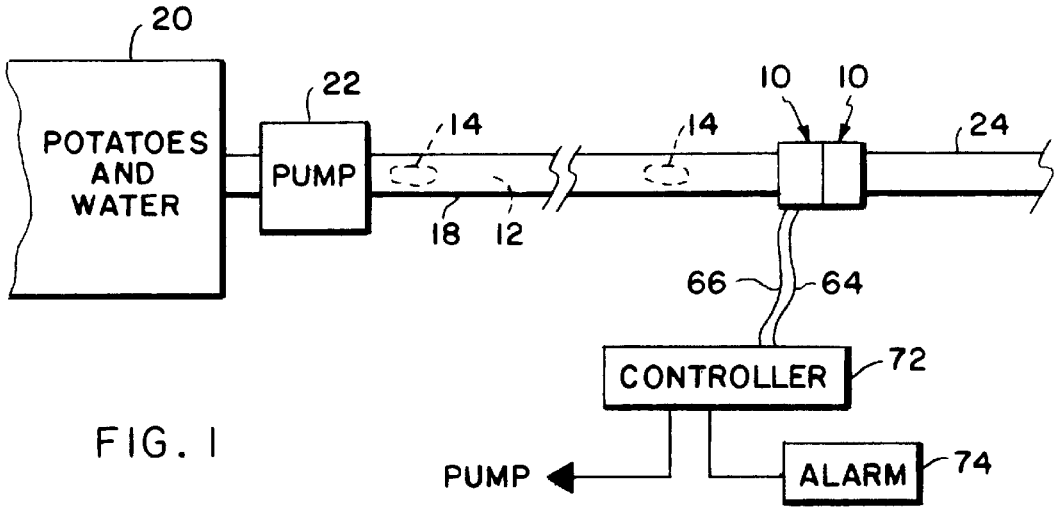
FIG. 1 is a schematic diagram depicting a production system for cutting potatoes or the like into elongated French fry strips, including a knife fixture and related broken blade detector in accordance with the novel features of the invention.

As shown in the exemplary drawings, an improved knife fixture referred to generally by the reference numeral 10 in FIG. 1 is provided for installation along a production flow passage 12 through which a vegetable product 14 such as a potato is propelled. The knife fixture 10 includes a plurality of knife blades 16 (FIGS. 2–4) for cutting the product 14 into elongated strips. The knife fixture 10 is equipped with means for promptly detecting the occurrence of a broken knife blade 16, so that a broken blade can be quickly repaired or replaced to permit resumption of cutting production.

The knife fixture 10 of the present invention is designed for use in conjunction with a conventional hydraulic pumping arrangement for pumping the vegetable products, particularly potatoes, one at a time at a relatively high velocity along a pressure conduit 18 into cutting engagement with the knife blades 16 for strip cutting. More specifically, the potatoes are pumped in succession with an hydraulic fluid such as water from a reservoir 20 by a pump 22 for relatively high velocity flow through the pressure conduit 18. The pressure conduit 18 is coupled at a downstream end to the knife fixture 10, with the kinetic energy imparted to each potato being sufficient to propel the potato into cutting engagement with and through the knife fixture to divide the potato into elongated strips. A preferred general construction for the knife fixture 10 conforms with that shown and described in U.S. Pat. No. 5,343,623, which is incorporated by reference herein, with a pair of the knife fixtures 10 being mounted in close back-to-back relation with their respective sets of knife blades oriented perpendicular to each other, to cut whole potatoes into French fry strips. The pressure conduit 18 and related pumping means is constructed in one preferred form according to that shown and described in U.S. Pat. No. 4,423,652, which is also incorporated by reference herein. The cut potato strips are discharged from the knife fixtures 10 through an appropriate discharge conduit 24 for further processing and packaging.

Figure 2:
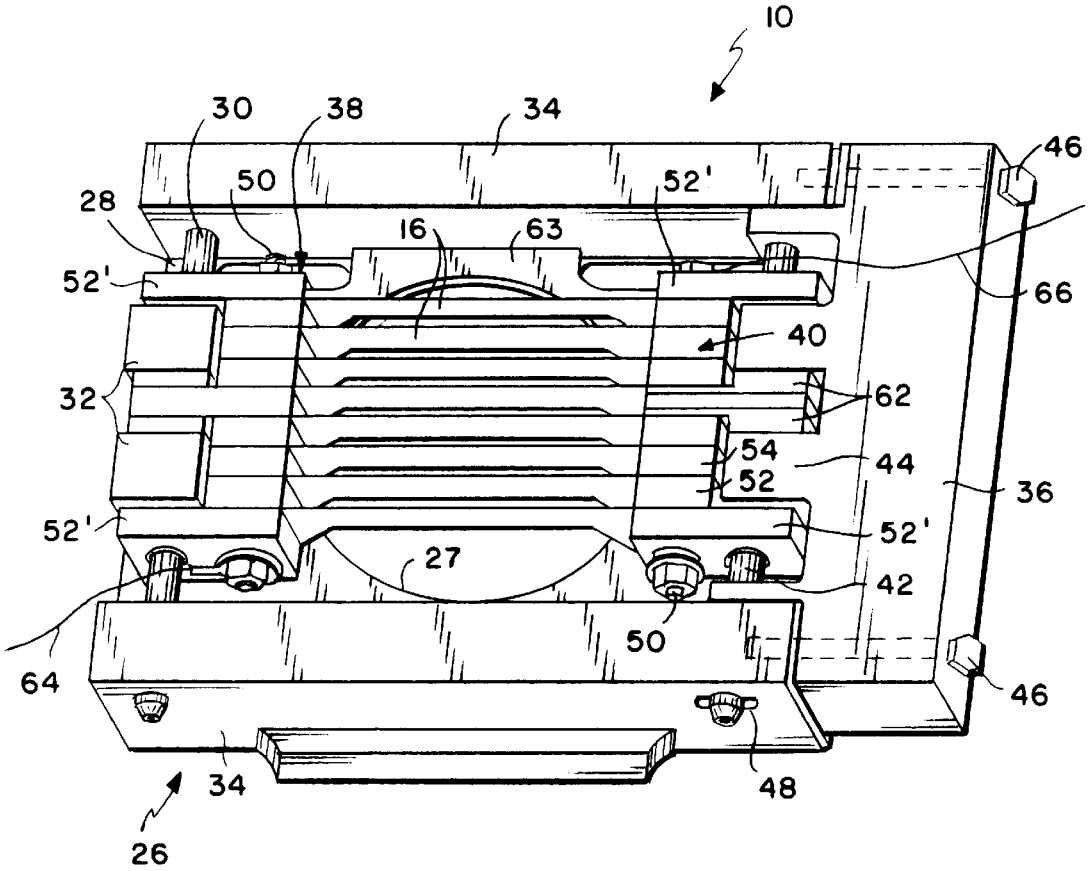
FIG. 2 is an enlarged rear side perspective view of a knife fixture with broken blade detector in accordance with the invention, for use in the production system of FIG. 1.
Figure 3:
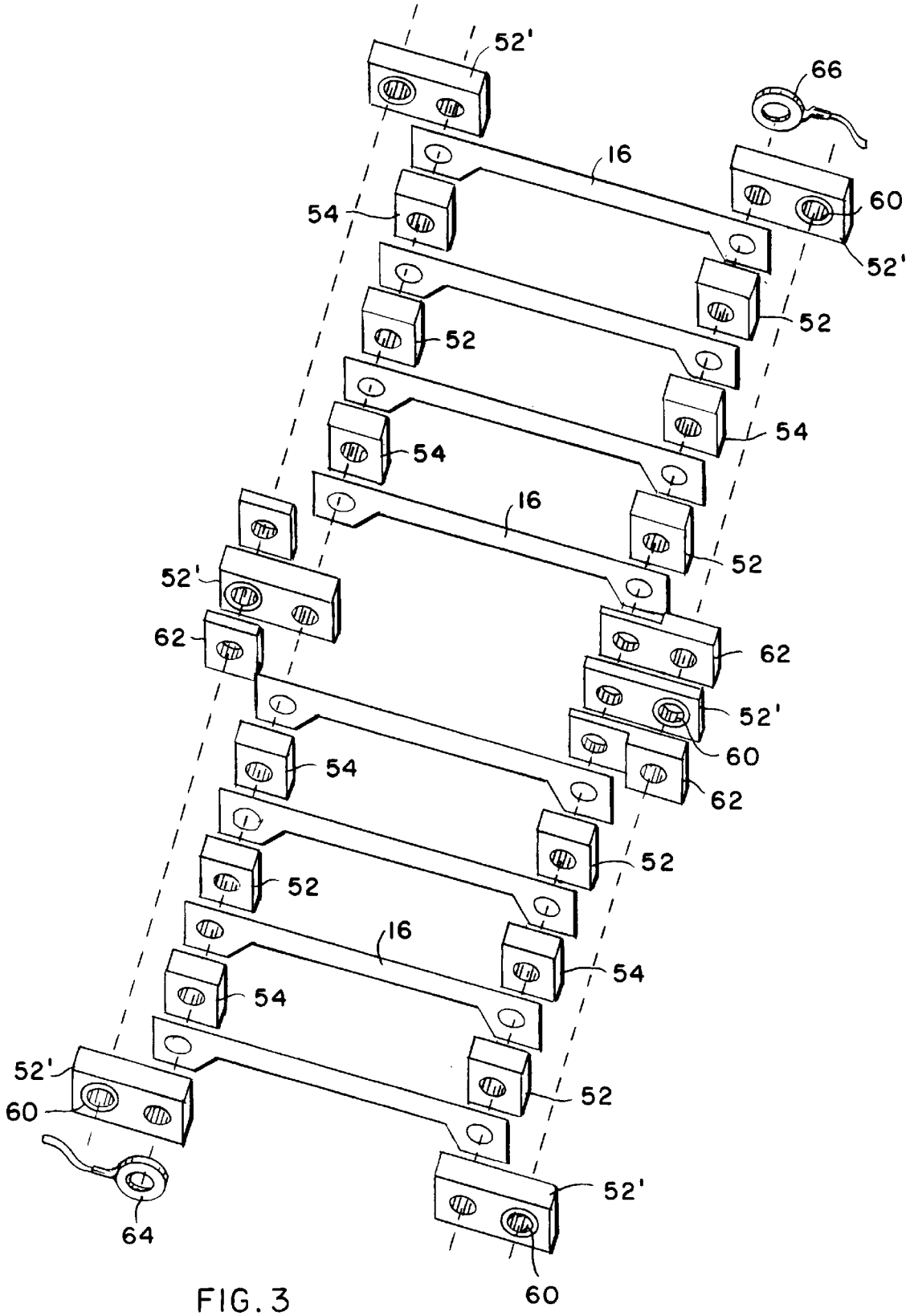
FIG. 3 is an exploded perspective view showing assembly of a portion of the knife fixture of FIG. 2.
Figure 4:
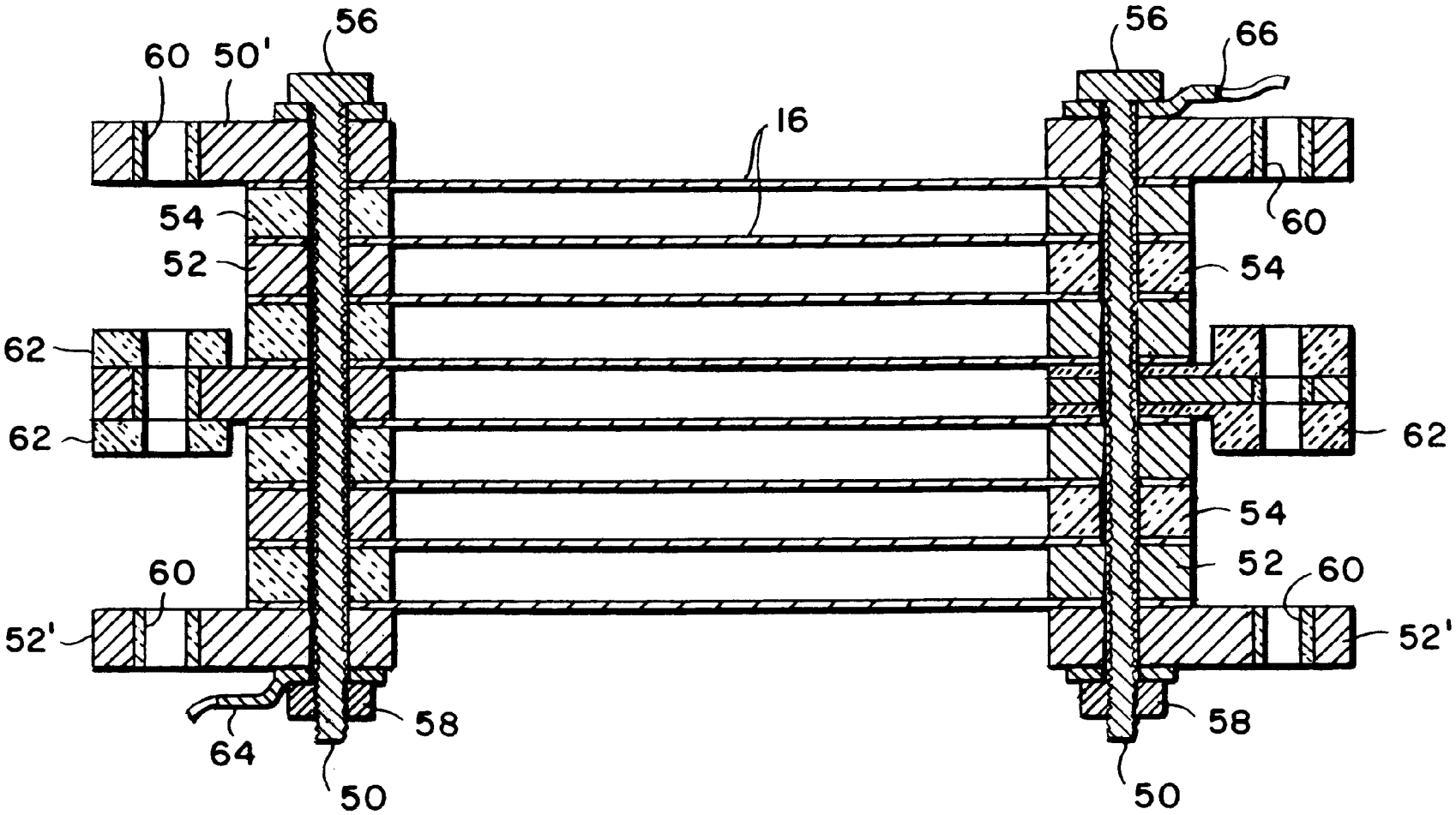
FIG. 4 is a cross sectional view of the knife fixture portion of FIG. 3.

The knife fixture 10 is shown in more detail in FIGS. 2–4, to include the plurality of knife blades 16 mounted on a generally rectangular fixture frame 26 adapted for mounting in turn at the downstream end of the pressure conduit 18 along the production passage 12. As shown, the fixture frame 26 supports the knife blades 16 in parallel spaced array to extend across a central opening 27 in the fixture through which the potatoes are propelled. The knife blades 16 are thus positioned for dividing each potato into elongated slices. When two of the knife fixtures 10 are mounted in succession along the production passage 12, as viewed in FIG. 1, with their respective sets of knife blades 16 oriented at right angles to each other, the two knife fixtures 10 together cut each potato into elongated French fry strips having a cross sectional dimension controlled by the knife blade spacing in each fixture. In accordance with the present invention, the broken blade detector and related detection method are applied to at least the leading one of the pair of knife fixtures to provide a prompt and substantially immediate indication of a broken knife blade which can occur, for example, when a foreign object such as a rock is propelled along the production passage 12 into engagement with the knife fixture. It will be understood, however, that the broken blade detector and method of the present invention may be applied to both the leading and trailing knife fixtures, if desired.

As shown is FIGS. 2–4, the preferred knife fixture construction comprises the fixture frame 26 to include a base member 28 in the form of a central plate with the opening 27 formed therein. A pair of side rails 34 extend along a rear face of the central plate and are interconnected along one edge of the frame 26 by a first anchor bolt 30 which also extends transversely through a pair of mounting blocks 32 formed on the rear face of the central frame plate.

In general terms, the first anchor bolt 30 and the mounting blocks 32 provide means for supporting one end of each knife blade 16, with the opposite ends of the knife blades being supported by a tension bar 36 mounted on the base member 28 at an opposite end thereof. The plurality of knife blades 16 are supported in tension to extend in parallel between the anchor bolt 30 and the tension bar 36, all as shown and described in the above-referenced U.S. Pat. No. 5,343,623.

More particularly, the opposite ends of the knife blades 16 are assembled with a pair of generally E-shaped support units 38 and 40, and these support units 38, 40 in turn provide structural means for mounting the set of knife blades to the fixture frame 26. The first support unit 38 couples the knife blades to the first anchor bolt 30 and the related mounting blocks 32, whereas the second support unit 40 couples the knife blades to a second anchor bolt 42 carried on mounting blocks 44 formed on the tension bar 36. As described in U.S. Pat. No. 5,343,623, a pair of adjustment screws 46 are threadably carried in the opposite ends of the tension bar 36 and seated within shallow counterbores at the ends of the side rails 34, wherein these adjustment screws 46 can be advanced within the tension bar 36 to draw the tension bar away from the ends of the side rails 34 and thereby apply an increased tension force to the knife blades 16, as will be described in more detail. The anchor bolt 42 can be received in elongated slots 48 in the side rails 34 to permit such tension adjustment.

The E-shaped support units 38 and 40 each comprise a transversely extending support pin 50 having a plurality of conductive spacer elements 52 and insulative space elements 54 assembled with the knife blades 16 in an alternating stacked array, as viewed in FIG. 3. That is, the spacer elements 52 and 54 and the knife blades 16 respectively have appropriate open ports formed therein to permit simple slide-on stacked assembly onto the associated support pin 50, and for retention thereon by means of an enlarged head 56 and a thread-on nut 58 (FIG. 4) disposed at opposite ends of each support pin 50. A plurality of the conductive spacer elements 52' are longitudinally elongated to extend from the support pin 50, providing the support units with the E-shaped geometry when three spaced-apart elongated spacer elements 52' are used as shown, wherein these elongated spacer elements includes additional open ports for slide-on reception of the associated first or second anchor bolt 30 or 42. With this construction, the knife blades 16 are supported to extend between the support units 38, 40, which are in turn supported between the frame base member 28 and the tension bar 36 to accommodate tension bar adjustment to apply a selected tension to the knife blades, as previously described.

In accordance with a primary aspect of the invention, the spacer elements 52, 54 arrange the knife blades 16 in electrically series-connected relation. That is, the space elements 54 are formed from a suitable electrically insulative material, such as a high density insulator plastic or the like. Additionally, the elongated conductive spacer elements 52' include insulated bushings 60 (FIGS. 3 and 4) in the ports for connection to the respective anchor bolts 30, 42, to insulate these elements from the fixture frame 26. Further nonconductive spacers 62 may be provided to insulate the centrally positioned elongated spacer elements 52' from the associated mounting blocks 32,44, or from the adjacent knife blades as appropriate. An insulated shim 63 (FIG. 2) is also desirously provided between the support units 30, 40 and the central plate of the frame base member 28.

These nonconductive components are arranged in an alternating stacked array with the conductive spacer elements 52 and 52' in a manner connecting the plurality of knife blades 16 electrically in series, as shown in FIGS. 3 and 4. A pair of terminal conductors 64 and 66 are connected with the support pins 50 at opposite corners of the assembled fixture to provide a low power electrical signal, such as on the order of about 10 milliamps, for series passage through the set of knife blades. The terminal conductors 64, 66 are connected to a controller 72 (FIG. 1) which includes suitable means for supplying and monitoring the electrical signal to the knife blades 16.

In production operation, the controller 72 monitors the electrical signal to identify the occurrence of a broken blade 16. That is, when a broken blade occurs, the controller 72 detects the resultant interruption in the electrical circuit including the blades, as evidenced by a drop in the detected current. The controller 72 can be programmed to activate an audio and/or visual alarm 74 (FIG. 1), and/or to automatically respond to the detected broken blade by de-activating the pump 22 used to deliver the potatoes in rapid succession to the knife fixture for cutting. Accordingly, the controller 72 responds to detection of the broken blade to prevent any significant clogging of the production passage 12 before the system is shut down for blade repair or replacement. Alternately, the controller 72 shuts down the system before any significant quantity of improperly cut product is produced as a result of the broken blade.

Figure 5:
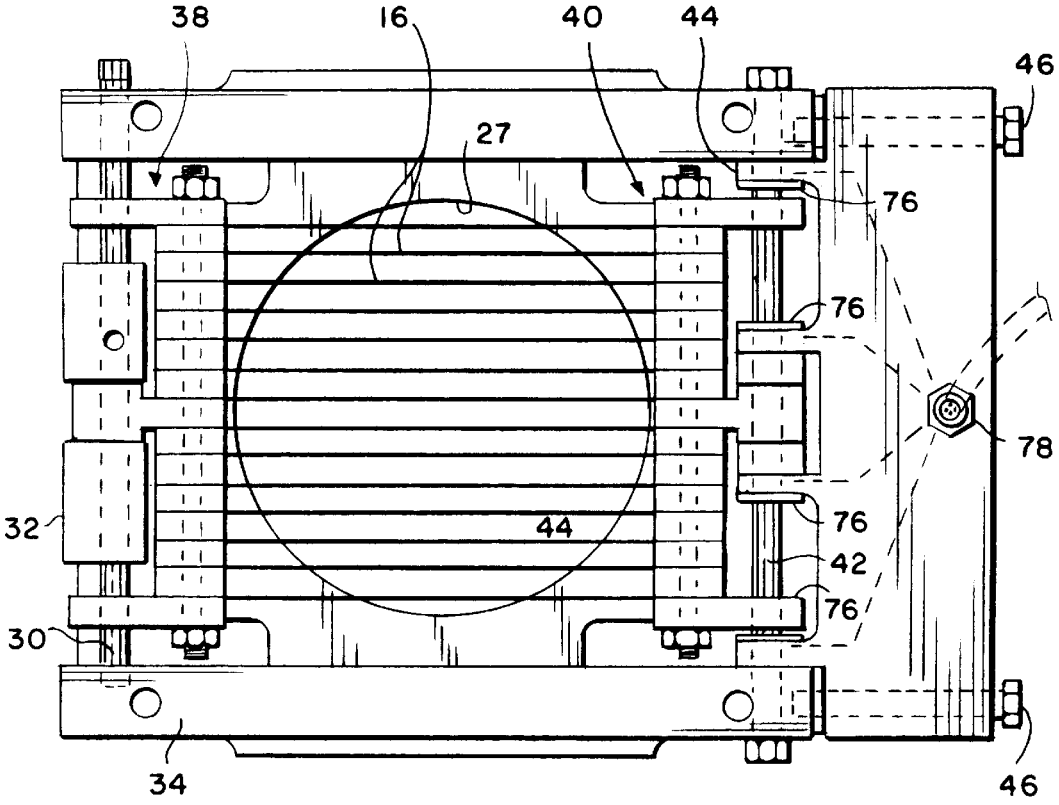
FIG. 5 is a plan view of a knife fixture in accordance with one alternative preferred form of the invention.

FIG. 5 illustrates an alternative preferred form of the invention, wherein structural components similar to those shown and described in FIGS. 1–4 are identified by common reference numerals. In this embodiment, the knife fixture 10 is equipped with one or more strain gauges 76 for monitoring the tension force applied to the set of knife blades 16, wherein the associated controller (not shown in FIG. 5) is programmed to respond to an abrupt decrease in the detected tension force indicative of a broken knife blade 16.

More specifically, as shown the tension bar 36 in this embodiment includes the plurality of strain gauges 76 mounted on the mounting blocks 44 which carry the second anchor bolt 42. These strain gauges 76, four of which are shown in the exemplary drawings, are designed to measure the tension force applied to the knife blades 16, as the adjustment screws 46 are advanced within the tension bar 36 to draw the knife blades 16 tightly between the E-shaped support units 38, 40, in the same manner as previously described. The strain gauges 76 are coupled by appropriate conductors which extend along or within the tension bar 36 to a cable connector 78 permitting the strain gauges 76 to be connected to the controller 72. The controller 72 monitors the tension forces during knife fixture operation to permit prompt detection of a broken knife blade.

The strain gauges 76 beneficially permit the initial tension force applied to the knife blades 16 by rotational setting of the adjustment screws 46 to be set at a substantially optimum level for cutting operation. In this regard, the adjustment screws 46 can be initially set to a predetermined specific tension level by utilizing the controller 72 to read actual tension force as the adjustment screws are rotated. Thereafter, during production operation of the knife fixture, the strain gauges 76 will provide an actual tension force reading to indicate breakage of a knife blade, as previously described. Alternately, or in addition, the strain gauges 76 permit the controller 72 to monitor slow or progressive changes in the knife blade tension, such as, for example, reduction in tension force associated with blade wear and fatigue over an extended period of time. The strain gauges 76 also permit detection of short tension spikes as typically occur, for example, when a foreign object such as a rock deforms the knife blades while passing therebetween without breaking a blade. The controller 72 can be set to detect such tension force spikes to provide an indication that a foreign object is present in the production stream.

Figure 6:
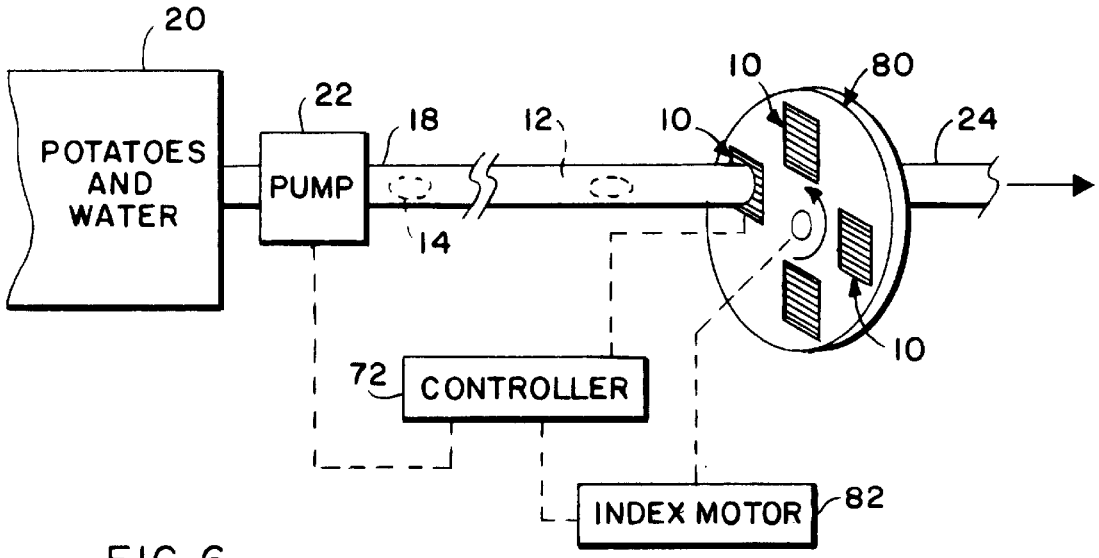
FIG. 6 is a schematic diagram illustrating an alternative production system utilizing the knife fixture with broken blade detector of the present invention.

FIG. 6 depicts the knife fixture 10 of the present invention, utilizing either the electrical conductor concept of FIGS. 1–4 or the strain gauge concept of FIG. 5, in a system adapted to automatically replace a knife fixture 10 containing a broken blade with a replacement fixture for substantially immediate resumption of normal production. As shown, a plurality of the knife fixtures 10 are mounted on a rotatable index wheel 80 positioned adjacent to the production passage 12 with one of the knife fixtures in an active position disposed in-line with the production passage for normal operation. The controller 72 responds to detection of a broken knife blade 16 in the active fixture, to substantially immediately operate an index motor 82 for rotating the index wheel 80 in a manner removing the fixture with the broken blade from the active position along the production passage, and replacing that fixture with a fresh knife fixture on the index wheel. If desired or required, the controller 72 can also interrupt the supply pump 22 for a brief interval sufficient to effect knife fixture changeover. Thus, production operation can be resumed with minimal interruption, while the fixture with broken blade is automatically removed from the production passage by the index wheel to a position for convenient access for repair or replacement. When the strain gauge concept of FIG. 5 is used, the controller 72 can similarly change the active knife fixture upon detection of a knife blade tension force indicative of excess blade wear prior to blade breakage.

The improved knife fixture of the present invention thus includes a relatively simple yet effective broken blade detector and method for quickly identifying a broken knife blade, so that appropriate remedial action can be taken substantially immediately. As a result, prolonged interruption of production operation and resultant wasted production capacity is substantially avoided. Moreover, significant plugging of the production passage, which can take an extended period of time to clear, is also avoided.

A variety of further modifications and improvements in and to the invention will be apparent to persons skilled in the art. For example, while the electrical conductor concept of FIGS. 1–4 has been shown and described with regard to connecting the knife blades 16 in series, it will be recognized and understood that the knife blades can be electrically connected in parallel, if desired. Accordingly, no limitation on the invention is intended by way of the foregoing description and the accompanying drawings, except as set forth in the appended claims.

What is claimed is:

1. A knife fixture for cutting food products, comprising:

a fixture frame having a central opening formed therein;

a plurality of knife blades;

means for mounting said knife blades on said fixture frame to extend in a generally parallel array across said central opening; and means on said fixture frame for detecting breakage of one of said knife blades.

2. The knife fixture of claim 1 wherein said mounting means includes means for supporting said knife blades under tension on said fixture frame.

3. The knife fixture of claim 1 wherein said detecting means comprises means for passing an electrical signal through said knife blades, and further including controller means for monitoring said electrical signal to detect changes therein indicative of a broken knife blade.

4. The knife fixture of claim 3 wherein said mounting means includes means for mounting said knife blades on said knife fixture in electrically connected series relation.

5. The knife fixture of claim 1 further including alarm means responsive to said detecting means to provide an indication of a broken knife blade.

6. A system for cutting food products, comprising:

conduit means defining a production passage;

product delivery means for causing food products to flow through said production passage;

a knife fixture mounted along said production passage, said knife fixture having a central opening formed therein and a plurality of knife blades mounted thereon to extend in spaced relation across said central opening to cut food products flowing through said production passage; and means on said knife fixture for detecting breakage of one of said knife blades.

7. The system of claim 6 wherein said knife fixture includes means for mounting said knife blades under tension on said fixture frame.

8. The system of claim 6 wherein said detecting means comprises means for passing an electrical signal through said knife blades, and further including controller means for monitoring said electrical signal to detect changes therein indicative of a broken knife blade.

9. The system of claim 8 wherein said knife fixture includes means for mounting said knife blades on said knife fixture in electrically connected series relation.

10. The system of claim 6 further including alarm means responsive to said detecting means to provide indication of a broken knife blade.

11. The system of claim 6 further including controller means responsive to detection of a broken knife blade to interrupt said product delivery means.

12. The system of claim 6 further including an index member having a plurality of said knife fixtures mounted thereon, said index member being movable in index steps to advance said knife fixtures one at a time to an active position mounted along said production passage, and further including controller means responsive to detection of a broken knife blade in the knife fixture disposed at said active position to move said index member through one index step to advance the next knife fixture in succession to said active position.

13. A knife fixture for cutting food products, comprising:

a fixture frame having a central opening formed therein;

a plurality of knife blades; and means for mounting said knife blades on said fixture frame to extend in spaced relation across said central opening, said mounting means supporting said knife blades in electrically connected series relation.

14. The knife fixture of claim 13 further including controller means for passing an electrical signal through said knife blades and for monitoring said signal for changes indicative of a broken knife blade.

15. A method of detecting a broken knife blade in a knife fixture having a plurality of knife blades for cutting food products, said method comprising the steps of:

passing an electrical signal through the knife blades; and monitoring changes in the electrical signal indicative of a broken knife blade.

16. The method of claim 15 further including the step of mounting the knife blades on the fixture in electrically connected series relation, said signal passing step comprising passing said signal in series through the knife blades.

17. The method of claim 16 further including the step of actuating an alarm upon detection of a broken knife blade.

* * * * *